United States Patent [19]

Blake

[11] Patent Number: 4,516,196

[45] Date of Patent: May 7, 1985

[54] LUMINAIRE HINGE AND LATCH

[75] Inventor: Walter R. Blake, Hendersonville, N.C.

[73] Assignee: General Electric Company, Schenectady, N.Y.

[21] Appl. No.: 514,736

[22] Filed: Jul. 18, 1983

[51] Int. Cl.[3] ..... F21V 3/00

[52] U.S. Cl. ..... 362/311; 362/267; 362/308; 362/310; 362/374; 362/375; 362/396; 362/223

[58] Field of Search ..... 362/267, 308, 310, 311, 362/374, 375, 396, 223

[56] References Cited

U.S. PATENT DOCUMENTS 3,069,541 12/1962 Thomsen et al. ..... 362/374 X
3,092,336 6/1963 Harling et al. ..... 362/374
3,096,029 7/1963 Berge ..... 362/374 X
3,654,453 4/1972 Jablonski ..... 362/374

*Primary Examiner*—Stephen J. Lechert, Jr.
*Attorney, Agent, or Firm*—Ernest W. Legree; Philip L. Schlamp; Fred Jacob

[57] ABSTRACT

In a luminaire comprising an upper housing assembly for a light source and a lower plastic refractor closing the underside and having a rim adapted to mate with that of the assembly, C-shaped latches are disposed around the periphery of said refractor for clamping the rims together when pivoted into position astride both rims. Circumferentially extending bail wires attach the latches to the underside of the refractor rim and allow them to be pivoted into clamping position while preventing them from dropping off when disengaged. The bail wires pass through holes molded in the plastic of the refractor rim.

6 Claims, 5 Drawing Figures

Fig. 2
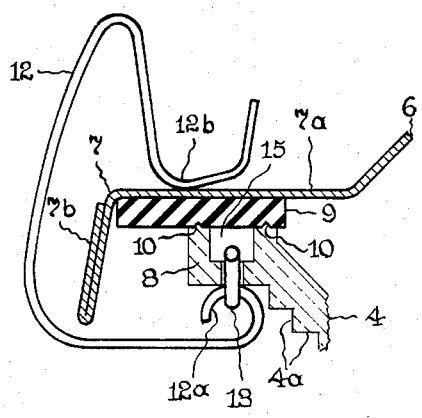
Fig. 3
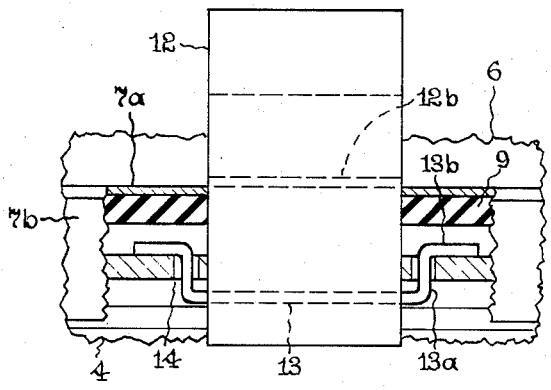
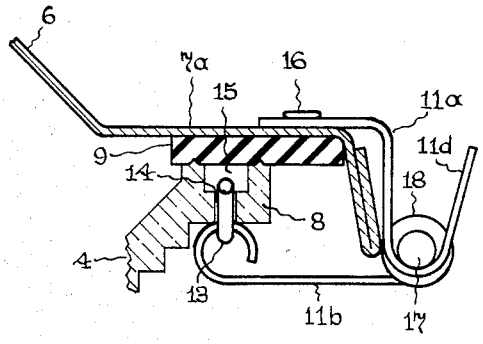
Fig. 4
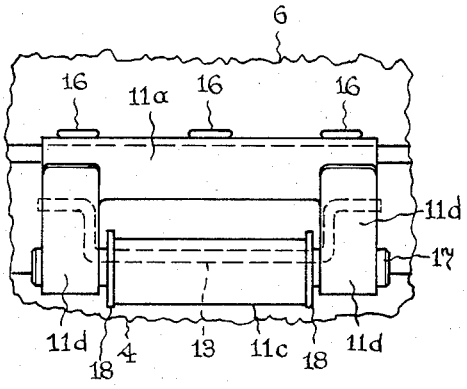
Fig. 5

LUMINAIRE HINGE AND LATCH

This invention relates to hinges and latches for luminaires of the type comprising a fixed lamp housing and reflector assembly and a light-transmitting refractor together with separable means fastening the refractor to the assembly but allowing separation for installation and service.

BACKGROUND OF THE INVENTION

It is necessary to have convenient access to the interior of luminaires for lamp replacement and service. A common arrangement favored for ceiling-mounted luminaires is to hinge the refractor to the lamp housing at one side so the refractor may be swung on the housing from closed to open position. Latch means are provided for locking the refractor in its closed position and for releasing it to give access to the interior. The refractor may vary from a simple flat light-transmitting plate or lens serving primarily as a window to keep out dirt and water, to an elaborately faceted clear bowl serving also to refract and redirect the light in particular directions.

Industrial luminaires of the foregoing type are frequently mounted at such heights that a ladder or elevated platform is used for servicing. For convenience and safety, a hinge and latch arrangement capable of being opened and closed by one hand, leaving to the workman his other hand free for supporting himself, is highly desirable.

The use of plastic instead of glass for the refractor has made relatively large low brightness luminaires practical for indoor use with low mounting heights. One can drill holes and drive screws into plastic but when doing so occasions stress concentrations, the plastic will develop cracks and deteriorate rapidly. For that reason the hinges and latches used with such plastic refractors have followed designs developed in the past for relatively heavy glass which avoided direct attachment of metal parts to glass. In one widely used design, the latching means comprise a metal clamp band encircling the entire refractor and a hinge and latches are attached to the metal band. This makes an elaborate and expensive design.

SUMMARY OF THE INVENTION

The object of the invention is to provide a hinge and separable latch arrangement suitable for use with a plastic refractor assembly and which is simpler and cheaper than what has been available up to the present.

In accordance with the invention, in a luminaire comprising an upper housing assembly for a light source and a plastic refractor separably fastened thereto, latches are provided which are attached directly to the plastic refractor without any metal clamp band. The latches are dimensioned to span the rims of both the housing assembly and of the refractor and apply the load directly to the surface of the refractor. Retaining means attach the latches directly to the underside of the rim of the plastic refractor in a manner allowing them to be pivoted into clamping position astride both rims.

In a preferred embodiment, several C-shaped latches forming resilient clamps are provided which press the flanged rim of the plastic refractor against the skirted rim of the upper housing. The latches exert pressure on the flanged rim substantially perpendicularly to the surface of the plastic and are wide enough to spread the load over a substantial area. By thus preventing any high stress in the plastic a long-lived assembly is achieved. When the refractor is unlatched, that is when the latches are disengaged from the rims, they are retained on the refractor by simple wire bails. The wire bails are inserted into sets of holes which were previously molded into the rim of the refractor for minimum stress on the plastic. Preferably a hinge is provided in addition to the latches and a similar bail attaches one of the plates of the hinge to the refractor.

DESCRIPTION OF DRAWINGS

In the drawings:

FIGS. 2 and 3 are partly sectioned side view and end view details of one of the latch clamps.

FIGS. 4 and 5 are side view and end view details of the hinge.

DETAILED DESCRIPTION

Figure 1:
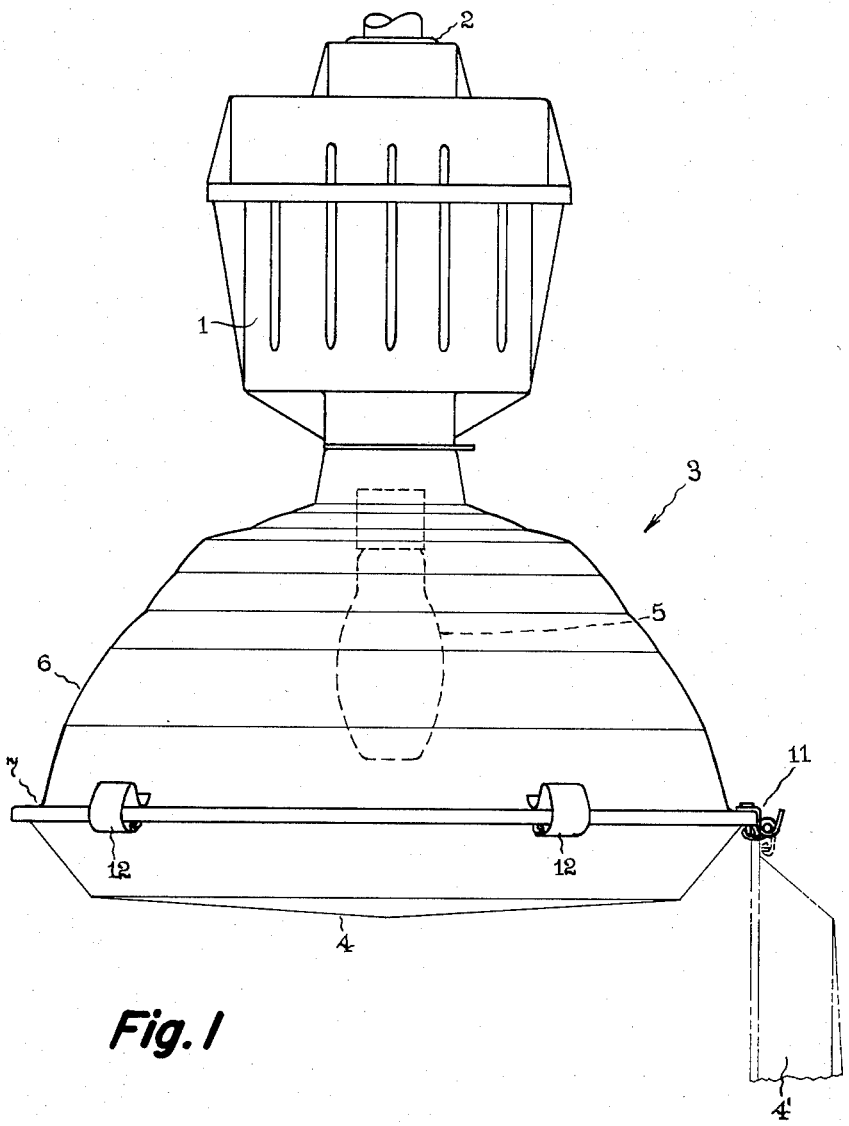
FIG. 1 is a side elevation view of an indoor type luminaire embodying the invention.

Referring now to the drawings and more particularly to FIG. 1, there is shown a low brightness industrial type luminaire particularly suitable for low mounting heights indoors. It comprises a generally box-like ribbed ballast housing 1, suitably of aluminum, having a threaded top-mounting hub 2 for attachment to metal conduit or pipe. The ballast housing contains the electrical operating components such as a ballast transformer and a capacitor (not shown), and the usual wiring compartment.

Suspended from the ballast housing is an optical assembly comprising a lamp housing and reflector assembly 3 and a refractor 4. The reflector assembly contains socket means accommodating an HID lamp 5 shown dotted, ordinarily a metal halide or a high pressure sodium vapor lamp. The reflector proper is polished aluminum formed into a domed or parabaloidal shape 6, suitably by spinning. The refractor 4 is a shallow somewhat dish-shaped light-transmitting plastic member having light control prisms 4*a* (FIG. 2) extending around the outer surface of its peripheral wall. The refractor is suitably made of a synthetic transparent plastic material, such as an acrylic resin stabilized against UV degradation or a polycarbonate resin, and is injection molded as a single piece.

As best seen in FIG. 2, the rim 7 at the bottom edge of the reflector 6 comprises a radially projecting flange portion 7*a* and a downwardly turned peripheral skirt portion 7*b*. The skirt portion is doubled over for greater stiffness at the rim. When refractor 4 is joined to the reflector, flanged rim 8 of the refractor mates with skirted rim 7 of the reflector. A sealing gasket 9 composed of a soft resilient material such as sponge rubber or other elastomeric material is accommodated within rim 7, being cemented to the underside of radial flange portion 7*a*. Flanged rim 8 is U-shaped in cross-section and each leg of the U is topped by a ridge 10 which helps to make a seal when pressed against gasket 9.

In the illustrated embodiment of the invention, the refractor is hingedly connected on one side to the reflector by hinge 11. When the refractor is swung down in order to gain access to the interior as shown in phantom view at 4' in FIG. 1, it is supported by the hinge alone. When swung up to its closed position, the refractor may be locked against the reflector by four clamping latches 12 circumferentially spaced around its flanged rim. Preferably two of the latches are located at 45° and two at 135° of circumference on each side of the hinge. In the normal closed position of the refractor, its weight is taken up entirely by the four latches. The location of the latches at 90° intervals around the circumference assures substantially even pressure against gasket 9 to assure a good seal.

The construction of the latches 12 and their mode of attachment to the refractor are best seen in FIGS. 2 and 3. The latches are made of thin resilient material such as spring steel and are generally C-shaped in cross-section. Each latch is pivotally attached to the flanged rim 8 of the plastic refractor by a wire bail 13 which extends in a circumferential direction through hoop portion 12*a* of the latch. The wire bail 13 has on each side a portion 13*a* bent up at 90° and passed through a premolded hole 14 in flanged rim 8, and then a portion 13*b* bent 90° again back to the circumferential as best seen in FIG. 3. The ends 13*b* of the bail lie in the medial groove 15 of the U-cross-section of refractor rim 8 and cause no interference. The latch is thus permanently attached to the plastic refractor so it will not drop off when unlatched or when the refractor is swung. When the latch is pivoted into the clamping position, the downwardly reverting sweep portion 12*b* presses down resiliently on reflector flange portion *7a*, thereby drawing the refractor up into sealing engagement with the gasket on the reflector.

Hinge 11, as best seen in FIGS. 4 and 5, is separable and comprises an upper bifurcated hinge plate 11*a* secured to the top of aluminum reflector flange *7a* by rivets 16, and a lower hinge plate 11*b*. The lower hinge plate is secured to the flanged rim 8 of the refractor in the same fashion as the latches 12, that is through a wire bail 13 having its ends bent over after extending through the holes 14 premolded in the plastic. A hinge pin 17 extending through hoop portion 11*c* on the lower hinge plate engages twin hook portions 11*d* of the upper plate to attach the two plates together. The hinge exerts no force upon the refractor when it is latched closed. When the refractor is swung down, it hangs by hinge 11 and the force transmitted through its bail wire 13 is merely the weight of the refractor. The resulting stress is moderate and since the refractor is swung open briefly only at long intervals apart, it has no effect on the life of the plastic refractor. The refractor can be removed by unhooking hinge pin 17 of the lower hinge plate from the twin hook portions 11*d* of the upper hinge plate. Gripping washers 18 on hinge pin 17 prevent it from sliding out of hoop portion 11*c*.

The compressive force which the latches 12 exert on the flanged rim of the refractor is transmitted through the hoop portions 12*a*, and to the reflector rim by the reverting sweep portion 12*b*. The force is at right angles to the surface of the plastic and extends the width of the latch so that the stress is spread over a substantial area. The bail wires of the latches produce no stress because all that they do is to prevent the latches from falling off when the refractor is swung down. Thus there are no high stress points in the plastic causing splitting and rapid degradation and this assures a long-lived assembly at minimum cost.

While the invention has been described with reference to a particular embodiment, it will be understood that numerous modifications may be made within the scope of the invention and the appended claims are intended to cover all such equivalent variations.

What I claim as new and desire to secure by Letters Patent of the United States is:

1. A separable latch arrangement in a luminaire comprising:

an upper housing assembly for a light source, said assembly having a rim with a radially projecting flange portion, a plastic refractor adapted to close the underside of the housing assembly, said refractor having a rim portion overhung by and adapted to mate with said projecting flange portion of the rim of said assembly, a plurality of latches disposed around the periphery of said refractor and dimensioned to span both rim portions for direct clamping action thereon, said latches being proportioned to press against the upper surface of said projecting flange portion and substantially perpendicularly against the lower surface of said plastic refractor rim portion over a substantial area whereby to avoid creating any high stress therein, and retaining means attaching said latches directly to the underside of the rim of said plastic refractor in a manner allowing them to be pivoted into clamping position astride both rims, said means preventing disengaged latches from dropping off the refractor.

2. An arrangement as in claim 1 wherein said retaining means comprise bail wires passing through holes molded in the plastic of the refractor rim portion.

3. An arrangement as in claim 2 wherein the latches are of thin resilient material and generally C-shaped with a hoop portion at one end and a reverting sweep portion at the other, and the attaching bail wires extend circumferentially through the hoop portions to allow rim clamping between the hoop portions and the reverting sweep portions when the latches are pivoted into clamping position astride both rim portions.

4. An arrangement as in claim 3 wherein the refractor rim portion has an axial groove on the upper side and the bail wires extending circumferentially through said hoop portions are bent at right angles to pass through said molded holes and bent back at right angles to lie circumferentially in said medial groove.

5. An arrangement as in claim 1 including means hinging said refractor to said upper housing assembly.

6. An arrangement as in claim 5 wherein said hinging means include a hinge plate having a hoop portion and a securing bail wire extends circumferentially through said hoop portion and passing through holes molded in the plastic of the refractor rim portion.

* * * * *